United States Patent [19]

Cutrara

[11] 4,289,237

[45] Sep. 15, 1981

[54] FIREWOOD PACKAGE

[76] Inventor: Anthony Cutrara, 76 Montressor Dr., Willowdale, Ontario, Canada, M2P 1Z4

[21] Appl. No.: 96,107

[22] Filed: Nov. 20, 1979

[51] Int. Cl.[3] ..... B65D 85/20

[52] U.S. Cl. ..... 206/443; 206/497

[58] Field of Search ..... 206/802, 471, 497, 443; 229/52 R, 52 A

[56] References Cited

U.S. PATENT DOCUMENTS

| | | | |
|---|---|---|---|
| T889,029 | 8/1971 | Greenwell | 206/497 |
| 2,075,711 | 3/1937 | Gilley | 206/443 |
| 3,037,620 | 6/1962 | Douty | 206/497 |
| 3,057,472 | 10/1962 | Douty | 206/497 |
| 3,140,814 | 7/1964 | Ellis | 229/52 A |
| 3,294,225 | 12/1966 | Kenyon | 206/443 |
| 3,442,436 | 5/1969 | Kirby, Jr. | 206/497 |
| 3,532,214 | 10/1970 | Helms | 206/497 |
| 3,764,351 | 10/1973 | Whittington et al. | 206/802 |
| 3,804,235 | 4/1974 | Anderson | 206/497 |
| 4,078,659 | 3/1978 | Rensner | 206/497 |

FOREIGN PATENT DOCUMENTS

| | | | |
|---|---|---|---|
| 2140668 | 3/1972 | Fed. Rep. of Germany | 206/497 |
| 2807906 | 8/1979 | Fed. Rep. of Germany | 206/443 |

*Primary Examiner*—Joseph Man-Fu Moy

*Attorney, Agent, or Firm*—Rogers, Bereskin & Parr

[57] ABSTRACT

A firewood package suitable for merchandising in stores is disclosed. The package is made up of a generally cylindrical bundle of lengths of firewood tightly encircled by a strap. A film of a plastic material is secured around the generally curved surface of the bundle while leaving both ends of the bundle exposed. The plastic material is perforated to permit air to circulate into and through the bundle by way of the perforations and open ends of the bundle. The package also includes a handle for convenient carrying.

8 Claims, 1 Drawing Figure

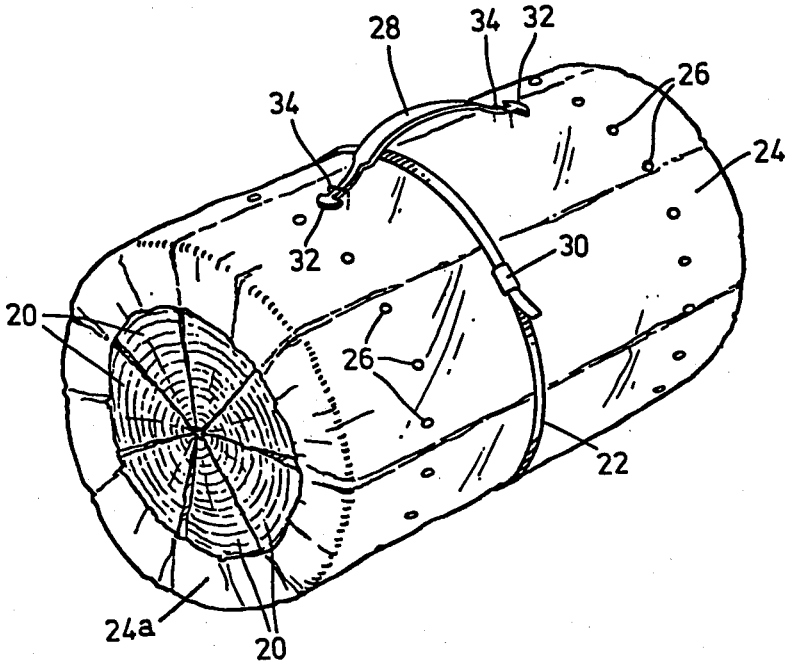
28
34
32
26
34
24
32
30
20
26
22
24a
20

FIREWOOD PACKAGE

This invention relates generally to the merchandising of firewood, primarily to domestic users.

Traditionally, firewood has been sold to domestic users in the form of cut logs, by the cord or face cord. A cord represents a large volume of wood and is not easily transported or stored, particularly in an urban environment. Also, a full cord or even a face cord is often more than the occasional domestic user will require. As a result, there is a strong demand for smaller quantities of firewood in a form which can be readily handled and stored.

Firewood bundles held together by string or the like are sometimes sold particularly at camp sites for camp fire use. However, even in this form, wood is often dirty and inconvenient to handle. The wood itself usually carries residual amounts of soil, wood chips, bark etc. which tend to fall from the bundle as the wood dries out. The string may also become slack and allow the bundle to fall apart or become unwieldy. Stores are therefore often reluctant to carry firewood in this form, and even where it is carried, consumer acceptance is low.

An object of the present invention is to make firewood available in a convenient form for merchandising in stores.

According to the invention there is provided a firewood package which includes a plurality of lengths of firewood arranged generally parallel to one another and a strap which tightly encircles the firewood length and holds them together to form a unitary bundle of generally cylindrical shape. The firewood lengths are sized so that the bundle can conveniently be carried. A film of a plastic material is secured around the generally curved surface of the bundle while leaving both ends of the bundle exposed. The plastic material is perforated to permit air to circulate into and through the bundle by way of the perforations and open ends of the bundle. A carrying handle is attached to the bundle and is accessible from externally of the film of plastic material for facilitating carrying of the bundle.

In order that the invention may be more clearly understood, reference will now be made to the accompanying drawing which is a perspective view of a firewood package according to preferred embodiment of the invention.

Referring to the drawing, the package includes a plurality of lengths of firewood 20 arranged generally parallel to one another. A strap 22 tightly encircles the firewood lengths and holds them together to form a unitary bundle of generally cylindrical shape. The length 20 are sized so that the bundle can conveniently be carried. A film of 24 of plastic material is secured around the generally curved surface of the bundle leaving both ends of the bundle exposed and the plastic material is perforated as indicated at 26 to permit air to circulate into and through the bundle by way of the perforations and open ends of the bundle. A carrying handle 28 is attached to the bundle and is accessible from externally of the plastic film for facilitating carrying of the bundle.

In this embodiment, the lengths of firewood 20 are each of segmental shape in cross section and fit together so as to define a generally cylindrical overall shape. Preferably, the segments in a bundle are all formed by splitting the same section of a log into the required number of pieces. This makes for a very compact bundle but is not essential. Segments from different logs could be assembled in the same fashion. In another case, the bundle could comprise, say, a plurality of lengths of thin and flat firewood.

Strap 22 is in the form of a narrow and flat nylon web and is drawn tightly around the bundle of firewood using a mechanical strapping device (not shown). The ends of the web are then heat sealed together in known manner, as generally indicated at 30, for securing the strap around the bundle. Within the broad scope of the invention, it would be possible to employ a strap made of any appropriate high tensile strapping material, such as cord or heavy string although a mechanically applied strap such as that shown is to be preferred since it holds the bundle of firewood together much more firmly than is normally possible with a hand tightened strap.

The plastic film 24 is shrink wrapped around the bundle of firewood lengths and overlies the strap 22. In this particular embodiment, the film is a polyethelene film prepunched with two rows of perforations 26. The film is applied to the bundle by a conventional plastic shrink wrapping technique.

As noted previously, the perforations 26, coupled with the open ends of the bundle, allow the wood to "breath" even though it is wrapped in a plastic material. This means that the wood can dry out naturally even while on display in a store. At the same time, the plastic film will retain any pieces of bark, wood or any other material which might otherwise fall from the bundle. It has been found preferable from the viewpoint of retaining foreign material to carry the shrink wrapped film over the marginal portions of the ends of the bundle of wood as indicated at one end by the reference numeral 24*a*. It has been found this arrangement still allows adequate "breathing" of the wood. However, in an alternative embodiment, the plastic film could cover the curved external surface of the bundle only.

The carrying handle 28 is in the form of a plastic moulding having T-shaped end portions 32. The handle is attached to the bundle by two staples 34, each of which straddles the stem of one of the T-shaped end portions and is driven into one of the lengths of firewood 20 through the plastic film. The handle could of course take other forms. For example, it could be formed by a length of the nylon web used to form strap 22, stapled to the bundle, or a portion of the strap 22 could be taken through the plastic film and stapled to one of the pieces of firewood.

It has been found in practice that the firewood package provided by the invention makes for clean and convenient storage of manageable amounts of firewood. The packages can conveniently be displayed in a supermarket or other store for sale and will not cause litter or an unsightly appearance. A package can conveniently be carried home by a purchaser and stored in its shrink wrapping until the wood is to be used.

It will of course be appreciated that the preceding description relates to a specific embodiment of the invention and that many modifications are possible. For example, the particular materials referred to above for the shrink wrapping and straps are not essential. Also, the plastic film need not be applied by a shrink wrapping technique. The film could be simply wrapped around the bundle and secured by staples or adhesive. The perforations in the film may be differently arranged and sized compared with the perforations shown in the drawing. For example, randomly distributed pin-point perforations could be made.

I claim:

1. A firewood package comprising: a plurality of lengths of firewood arranged generally parallel to one another; a strap tightly encircling said firewood lengths and holding the same together to form a unitary bundle of generally cylindrical shape, the firewood lengths being sized so that said bundle can be conveniently carried; a film of a plastic material secured around the generally curved surface of the bundle and extending around peripheral regions only of opposed ends of the bundle, the remainder of said bundle ends being exposed to atmosphere, said film being formed with a plurality of perforations to permit air circulation into and through the bundle by way of said perforations and open ends of the bundle; and a carrying handle attached to said bundle; and a carrying handle attached to said bundle and accessible from externally of the film of plastic material for facilitating carrying of the bundle.

2. A package as claimed in claim 1, wherein each of said firewood lengths is of segmental shape in cross section and the lengths are fitted together so that the said segments cooperate to define said generally cylindrical shape.

3. A package as claimed in claim 1, wherein said strap comprises a flat strip of high-tensile strapping material mechanically secured around said bundle.

4. A package as claimed in claim 1, wherein said plastic film is secured around the bundle by shrink wrapping, and wherein said perforations are arranged in two generally parallel rows encircling said bundle.

5. A package as claimed in claim 4, wherein said shrink wrapped film extends over peripheral portions of said ends of the bundle.

6. A package as claimed in claim 4, wherein said plastic material is polyethelene film.

7. A package as claimed in claim 3, where said strapping is a nylon web.

8. A package as claimed in claim 1, wherein said handle comprises a plastic moulding having T-shaped end portions, each secured to said bundle by a staple which straddles the stem of said T-shaped end portion of the handle and is driven through said plastic material and into one of said lengths of firewood.

* * * * *